United States Patent [19]

Holley

[11] Patent Number: 4,561,198

[45] Date of Patent: Dec. 31, 1985

[54] METHOD AND APPARATUS FOR SCARIFYING A RAILROAD CRIB

[75] Inventor: John D. Holley, Montgomery, Ala.

[73] Assignee: Holley Engineering Company, Inc., Montgomery, Ala.

[21] Appl. No.: 666,059

[22] Filed: Oct. 29, 1984

[51] Int. Cl.[4] ..... E02F 5/22

[52] U.S. Cl. ..... 37/104; 241/194

[58] Field of Search ..... 83/543; 241/289, 290, 241/193, 194; 56/10.4, 29; 37/104, 105; 172/45

[56] References Cited

U.S. PATENT DOCUMENTS

| | | | |
|---|---|---|---|
| 2,045,689 | 6/1936 | Armstrong | 241/194 |
| 2,463,499 | 3/1949 | Thornley | 37/104 |
| 2,534,880 | 12/1950 | Praytor et al. | 37/104 |
| 3,005,274 | 10/1961 | Kershaw | 37/104 |
| 3,611,681 | 10/1971 | Blanton et al. | 56/10.4 |
| 4,120,106 | 10/1978 | Smith et al. | 37/110 X |

*Primary Examiner*—Clifford D. Crowder

*Attorney, Agent, or Firm*—Kerkam, Stowell, Kondracki, & Clarke

[57] ABSTRACT

A railroad scarifying device is adapted to automatically distinguish between ballast and ties. The device includes a mounting piece or drum on which a plurality of hammer arms are pivotably attached. The hammer arms are pulled outwardly by the centrifugal force of rotation of the drum and include hammer teeth to pound and fracture hardened ballast in between railroad ties. The hammer arms have a tie protector or tie protecting portion which strikes ties and causes the hammer arms to retract inwardly such that the teeth avoid damaging contact with the ties. The hammer arms include a stop slot which cooperates with a stop pin mounted on the drum so as to limit the range of pivoting of the hammer arms relative to the drum.

30 Claims, 8 Drawing Figures

METHOD AND APPARATUS FOR SCARIFYING A RAILROAD CRIB

BACKGROUND OF THE INVENTION

This invention relates to a method and apparatus for scarifying a railroad crib. More specifically, the invention provides for removal of ballast from in between adjacent railroad ties.

It is necessary to recondition railroad track beds from time to time. As part of this process, a cribbing operation is often performed. The cribbing operation occurs after a rail and its associated tie plates and rail anchors are removed from their normal location adjacent one side of the railroad ties.

The cribbing operation itself involves cleaning off the area of the ties on which the tie plates associated with the moved rail had been located. This allows for the later smoothing of the top of the tie for placement of new or recycled tie plates. Additionally, the cribbing operation requires the removal of ballast from in between the ties to provide room for the rail anchors. These anchors, as well known in the art, clip underneath the rail and bear against the sides of the ties to minimize creeping, expansion, or other movement of the continuous welded rail.

Rotary sweeping cores with a plurality of brush elements or bristles have typically been used for cribbing. Such brush elements are disclosed in my prior U.S. Pat. No. Re. 31,619, issued July 3, 1984 and entitled "SWEEPER BRISTLE AND METHOD OF MAKING". Although the brush elements may be mounted upon a rotary sweeper which rotates about an axis parallel to the ties for simply cleaning ties and evenly distributing the ballast, the cribbing operation uses the brush elements mounted for rotation on a sweeper core having a rotation axis perpendicular to the railroad ties. The brush elements are sufficiently flexible to bend as they sweep across a railroad tie, whereas they extend below the upper surfaces of the ties and dig or sweep ballast material out from in between the ties.

A problem in the cribbing operation is that certain types of ballast may be ground into quite fine particles. When it rains, the fine particles may set up like concrete such that it is too hard for flexible sweeper or brush elements to remove the ballast. Accordingly, some prior art machines having rotary sweeping cores for cribbing have also included scarifiers.

Typically, a prior art scarifier as used in cribbing has been a solid wheel with a number of hammer or digger teeth removably fixed at the periphery of the wheel. The teeth may be standard coal mining bits. As the vehicle having the cribbing sweeper and scarifier is moved along a railroad bed, an operator uses a control to lower the rotatable scarifying wheel between the ties. The operator must raise and lower the scarifier wheel in between each pair of adjacent ties which have the hardened ballast. The scarifier wheel rotates such that its teeth hammer against and dig into the hardened ballast. When the machine comes upon a section of the railroad bed which does not have the hardened ballast, the operator may simply maintain the scarifier wheel in an upper position away from the track bed. Sweeper elements may be disposed before and/or after the scarifier wheel, typically as part of the same vehicle.

Although the prior art cribbing scarifiers have been generally useful, they have been subject to a number of disadvantages. In particular, they have required an operator who raises and lowers the scarifier wheel in between each pair of adjacent ties as necessary to break cemented or hardened ballast. The operator either has to stop the machine to lower the scarifier wheel or, alternately, may lower the scarifier wheel when the machine or vehicle is moving sufficiently slow. If an operator tries to move the vehicle too quickly, the scarifier wheel will either not sufficiently break up the ballast (when the scarifier wheel remained in its lower position for too short a time) or strike a tie with its hammer teeth (when the scarifier wheel was maintained in its lower position for too long a time).

In addition to causing incomplete breakage of the hardened ballast and damage to ties, and requiring the additional labor cost of an operator to raise and lower the scarifier wheel in between adjacent ties, the prior art type of scarifier wheel is relatively slow in operation. That is, the operator who is concerned about properly breaking the hardened ballast without damaging the ties must run the vehicle at a relatively slow speed in order to minimize errors.

In the divergent area of cutting bushes and/or trimming trees, cutting wheels with knives pivotably mounted to the wheels have been used. The knives are extended by centrifugal force such that they will swing away from anything which is too hard or too thick for the knives to cut through it.

OBJECTS AND SUMMARY OF THE INVENTION

Accordingly, it is a primary object of the present invention to provide a new and improved railroad crib scarifying device.

A more specific object of the present invention is to provide a scarifying device for cribbing operations which is automatic in operation.

Another object of the present invention is to provide a scarifying device which ensures relatively complete breakup of hardened ballast without damaging railroad ties.

A still further object of the present invention is to provide a scarifying device which may move relatively quickly along a railroad bed.

Yet another object of the present invention is to provide a new and improved railroad crib scarifying vehicle.

A still further object of the present invention is to provide a new and improved method of scarifying a railroad crib.

The above and other objects of the present invention which will become apparent as the description proceeds are realized by an invention comprising a railroad crib scarifying device including a mounting piece and at least a first hammer arm movably attached to the mounting piece and operable to extend out a variable distance from the mounting piece, the first hammer arm having a first hammer portion and a first tie protecting portion, and wherein the device is operable to loosen up ballast in a railroad track bed with the first hammer arm automatically changing between:

I. a cribbing state with the first hammer portion extending downwardly between two adjacent railroad ties such that the first hammer portion is operative to strike and loosen up ballast between the two adjacent railroad ties; and II. a tie protecting state resulting from the first tie protecting portion contacting a railroad tie and preventing the first hammer portion from damaging the contacted railroad tie. Preferably, the scarifying device further includes: a second hammer arm having a second hammer portion and a second tie protecting portion and operable in cribbing and tie protecting states in the same manner as the first hammer arm. The mounting piece is completely rotatable in a first direction about a rotation axis, and the first hammer arm is operable to extend out in a fully extended position from the mounting piece by centrifugal force resulting from rotation of the mounting piece. The first tie protecting portion is operable to prevent the first hammer portion from damaging railroad ties by contacting the railroad ties and preventing the first hammer arm from maintaining its fully extended position. The device further includes: a first stop slot in one of the mounting piece and the first hammer arm, and a first stop pin extending within the first stop slot and fixed to the other of the mounting piece and first hammer arm. The first stop slot and the first stop pin are together operable to limit outward movement of the first hammer arm relative to the mounting piece. The first tie protecting portion is a flat leading surface on the first hammer arm and the first hammer portion includes a hammer tooth mounted on the hammer surface which lies behind the flat leading surface during rotation of the mounting piece. The flat leading surface is operable to strike ties when it is substantially parallel to upper surfaces of the ties. The device further includes second and third hammer arms having respective second and third hammer portions and respective second and third tie protecting portions, each of the second and third hammer arms being of like construction and like operation as set forth for the first hammer arm. The device further includes a second stop slot, second stop pin, third stop slot, and third stop pin, each stop slot operable in the same fashion as the first stop slot and each stop pin operable in the same fashion as the first stop pin. Each of the hammer arms is pivotably mounted to the mounting piece.

The present invention may alternately be described as a railroad crib scarifying device including a mounting piece, a first hammer portion, and a first tie protector portion, and wherein the device is rotatably operable to loosen up ballast in a railroad bed by providing automatic changing between:

I. a cribbing state with the first hammer portion between two adjacent railroad ties such that the first hammer portion is operative to strike and loosen up ballast between the two adjacent railroad ties; and II. a tie protecting state resulting from the first tie protecting portion contacting a railroad tie and preventing the first hammer portion from damaging the contacted railroad tie.

The first tie protecting portion is a flat leading surface and the first hammer portion includes a hammer tooth which lies behind the flat leading surface during rotation of the mounting piece. The device further includes second and third hammer portions and second and third tie protecting portions, each of the second and third portions of like construction and operation as set forth for the first hammer portion, and each of the second and third tie protecting portions being of like construction and like operation as set forth for the first tie protecting portion. The first hammer portion and the first tie protecting portion are part of a first hammer pivotably mounted to the mounting piece. The invention further comprises a railroad crib scarifying vehicle, and wherein the railroad scarifying device is mounted to the vehicle.

The present invention may alternately be described as a railroad crib scarifying vehicle including a scarifying system having a mounting piece, a first hammer portion, and a first tie protector, the scarifying system operable to loosen up ballast in a railroad track bed with the scarifying system providing automatic changing between:

I. a cribbing state with the first hammer portion extending downwardly between two adjacent railroad ties such that the first hammer portion is operative to strike and loosen up ballast between the two adjacent railroad ties; and II. a tie protecting state wherein the first tie protector indicates the presence of a railroad tie below the first hammer portion and prevents the first hammer portion from damaging the railroad tie.

The first tie protector is a flat leading surface and the first hammer portion includes a hammer tooth which lags behind the flat leading surface such that the first tie protector strike railroad ties and prevents the hammer tooth from damaging railroad ties. The first tie protector and the first hammer portion are part of a first hammer arm movably mounted to the mounting piece. The scarifying system further includes a second hammer arm and a second tie protector, each of like construction and like operation as set forth respectively for the first hammer portion and the first tie protector. The mounting piece at least partially rotates in a first direction about a rotation axis. The mounting piece is completely rotatable in a first direction about a rotation axis and wherein the first hammer portion lags behind the first tie protector during rotation of the mounting piece.

The present invention may alternately be described as a railroad crib scarifying device including a rotatable mounting piece and at least a first hammer arm movably attached to the mounting piece and operable to extend a variable distance from the mounting piece, a first stop slot in one of the mounting piece and the first hammer arm, a first stop pin extending within the first stop slot and fixed to the other of the mounting piece and the first hammer arm, and wherein the first hammer arm is operable to swing out from the mounting piece under centrifugal force resulting from rotation of the mounting piece, and wherein the first stop slot and the first stop pin are together operable to limit the outward movement of the first hammer arm relative to the mounting piece. The device further includes a second hammer arm movably mounted to the mounting piece, a second stop slot, and a second stop pin, each constructed and operable as set forth respectively for the first hammer arm, first stop slot, and first stop pin. The first hammer arm has a first hammer portion and a first tie protecting portion. The mounting piece is completely rotatable in a first direction about a rotation axis and the first hammer portion lags behind the first tie protecting portion during rotation of the mounting piece.

The method of the present invention may be described as a method of scarifying a railroad crib comprising the steps of: moving a scarifying device transverse to railroad ties, the scarifying device including a first hammer portion; repeatedly hitting ballast in between the ties with the first hammer portion extending down to below upper surfaces of the ties; sensing when the first hammer portion is over one of the ties by operation of a first tie protector; and automatically preventing the first hammer portion from extending down sufficiently far as to damage a tie when the first tie protector senses that the first hammer portion is over one of the ties. The scarifying device includes a mounting piece and a first hammer arm movably attached to the mounting piece and operable to extend out a variable distance from the mounting piece, the first hammer arm including the first hammer portion; and the hitting step corresponds to a cribbing state with the first hammer portion extending downwardly between two adjacent railroad ties such that the first hammer portion is operative to strike and loosen up ballast between the two adjacent railroad ties, and the preventing step corresponds to a tie protecting state wherein the first tie protector indicates the presence of a railroad tie below the first hammer portion and prevents the first hammer portion from damaging the railroad tie.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
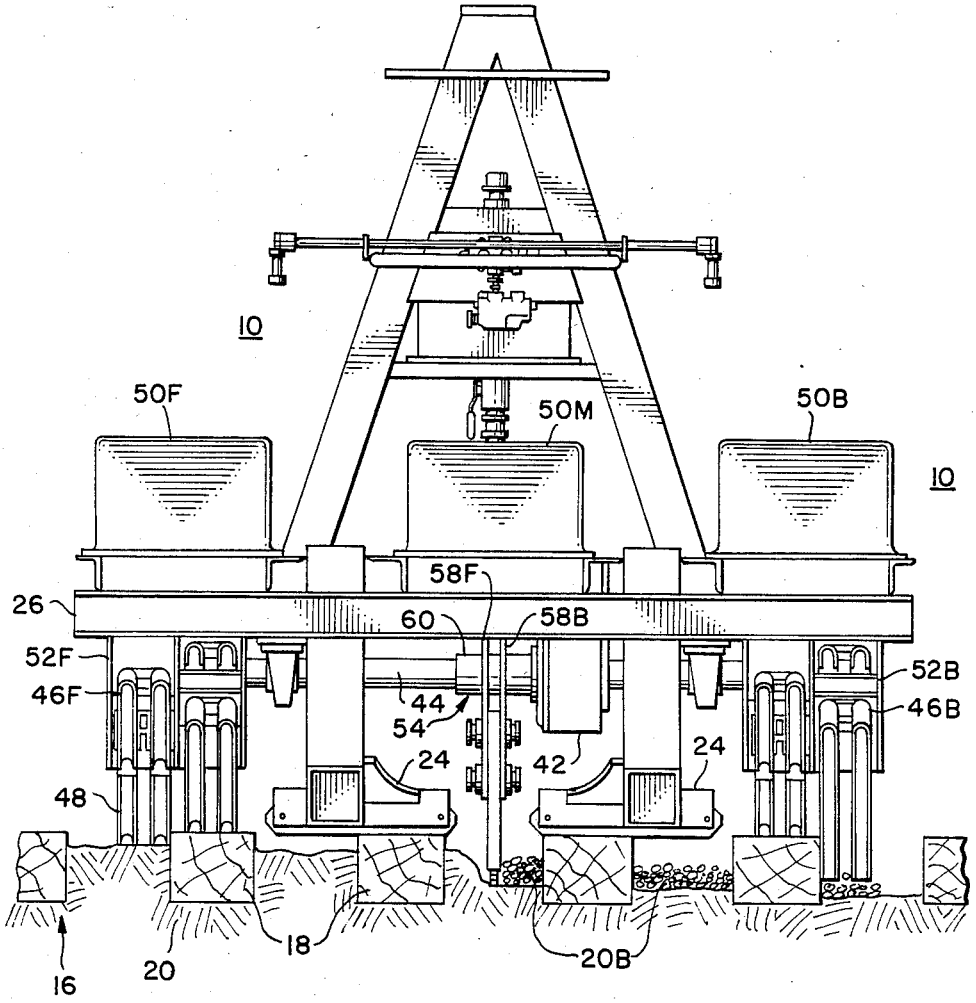
FIG. 1 shows a simplified side view of a vehicle according to the present invention.
Figure 2:
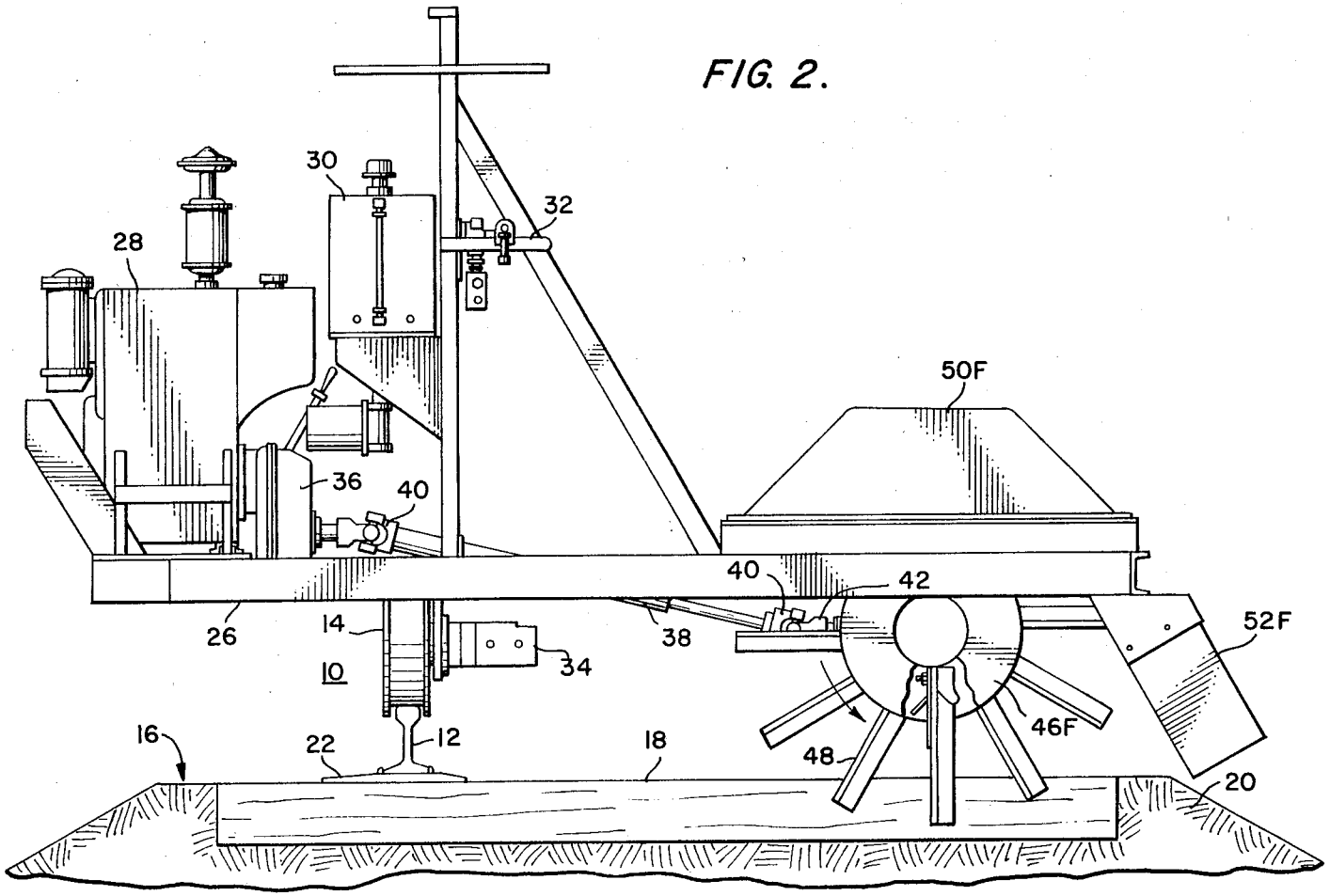
FIG. 2 shows a simplified front view of a vehicle according to the present invention.

With reference now to FIGS. 1 and 2, the railroad crib scarifying vehicle 10 according to the present invention will be discussed in detail. FIG. 1 shows a simplified side view in that a rail 12 (FIG. 2) and wheels 14 (FIG. 2) have been deleted to best illustrate the operation of the vehicle 10. FIG. 2 is a simplified front view of the vehicle 10.

The vehicle 10 is adapted to move along a railroad bed 16 having ties 18 with ballast 20 disposed there between. Mounted on top of the ties 18 is a single rail 12 associated with a plurality of tie plates 22 (only one of which is shown). The other rail has been removed from its usual position on top of the ties 18 such that the ties 18 may be refurbished prior to replacement of the rail.

The vehicle 10 is operable to move along the single rail 12 by way of two wheels 14 (only the front wheel is visible in FIG. 2) and skids 24 (FIG. 1 only). The skids 24 are on the opposite side of the frame 26 from the wheels 14.

An engine 28 is used to power the vehicle 10 by way of hydraulic tank 30, control valve 32, and hydraulic motor 34 in a manner well-known in the art (see especially FIG. 2). Hydraulic power tubes, not shown, may connect the valve 32 to the hydraulic motor 34. The engine 28 additionally powers a clutch power takeoff 36. The clutch 36 in turn powers a telescoping drive shaft 38 having U-joints 40 at each end. The U-joint 40 furthest from the clutch 36 is connected to an input right angle drive 42 which powers a drive shaft 44 extending transverse to the ties 18 as best shown in FIG. 1. The drive shaft 44 is used to power front and back sweepers 46F and 46B each having a number of sweeper elements 48 which may for example be constructed as with my above referenced previous patent. Other sweeper elements could of course be used. The sweeper elements 48 clamp to the sweepers 46F and 46B in a known manner. Fiberglass covers 50F and 50B and spray guards 52F and 52B are attached to the frame 26 to minimize the possibility of injury caused by material thrown by the rotary sweepers 46F and 46B respectively. Additionally, the spray guards prevent the ballast material 20 from being thrown too far from the bed 16.

In addition to driving the sweepers 46F and 46B, the drive shaft 44 is used to drive the scarifier device 54 (FIG. 1 only) of the present invention. A middle cover 50M may be disposed above the scarifier 54 and a spray guard (not shown but similar to guards 52F and 52B) may also be used for the scarifier 54. For ease of illustration, the scarifier 54 is not shown in FIG. 2, but it will be readily appreciated that the scarifier 54 would be behind and coaxial to the front sweeper 46F of FIG. 2. The skids 24, which are also left out of FIG. 2 to ease illustration of other features, would be disposed at the right side of frame 26 in the view of FIG. 2.

The construction of the scarifier or scarifying device 54 will now be discussed with reference to FIGS. 3–6. The scarifier 54 includes a generally circular drum or mounting piece 56. The drum 56 may include front and back drum halves 58F and 58B which may be welded or otherwise fixed to a sleeve 60 (see also FIG. 1). The sleeve 60 may include a keyed hole 62 for drivably connecting it to the drive shaft 44. The drive shaft 44 may include a key (not shown) to correspond to the key opening in hole 62.

Mounted between the two drum halves 58F and 58B are a plurality of hammer arms 64, each of which is identically constructed and mounted to the mounting piece or drum 56. The hammer arms 64 serve as hammer means as discussed in detail below. In particular, each hammer arm 64 is pivotably mounted to the mounting piece 56 by a pivot pin bolt 66 and associated nut 68 (see especially FIG. 4). Front and back sleeves 70F and 70B, which may be welded respectively to front and back drum halves 58F and 58B contain an intermediate member or pivot pin 72 which is generally cylindrical with a widened radius at its center and includes a hole to accomodate the bolt 66. Rubber compression material 74F and 74B is disposed in between the welded boss sleeves 70F and 70B and is trapped by the washers 76F and 76B. The hammer arm 64 is sufficiently thinner than the distance between the drum halves 58F and 58B as to allow it to really pivot about the intermediate member or pivot pin 72.

In addition to being pivotably mounted to the drum 56 by the bolt 66 and associated parts, the hammer arms 64 are slidably to the drum 56 by a stop pin bolt 78. The stop pin bolt 78 has associated washers, boss sleeves, internal stop pin, and rubber compression material in the same manner as the construction detailed for FIG. 4. The only difference is that the bolt 78 and associated parts slidably connect the hammer arm 64 to the drum 56 by way of the slot 80 disposed in the hammer arm 64. The slot 80, which functions as a stop slot, extends from a flat leading surface tie protecting portion or tie protector 82 of the hammer arm 64 back towards a trailing edge 84 of the hammer arm 64. The slot 80 is configured to allow the hammer arm 64 to pivot about bolt 66 relative to the drum or mounting piece 56.

A hammer portion 86 is disposed at the outer end of the hammer arm 64 and includes a hammer tooth 88 removably attached to the hammer arm 64. The tooth 88, which may be a coal mining carbide cutter bit as previously used in railroad scarifying operations, may be mounted to the hammer arm 64 in the manner shown in FIG. 5. In particular, the hammer arm 64 has a cut out section in which parts 90F and 90B have been welded. The shank of bit or tooth 88 is slid between the two parts 90F and 90B and a roll pin is forcibly driven through the illustrated holes in parts 90F, 90B and the shank of tooth 88. The roll pin is oversized and holds the tooth 88 in place by compression. When the tooth 88 is worn out, a tool may be used to punch the roll pin 87 out from the holes in the side plates 90F and 90B and the tooth 88. The tooth may thus be replaced.

Figure 3:
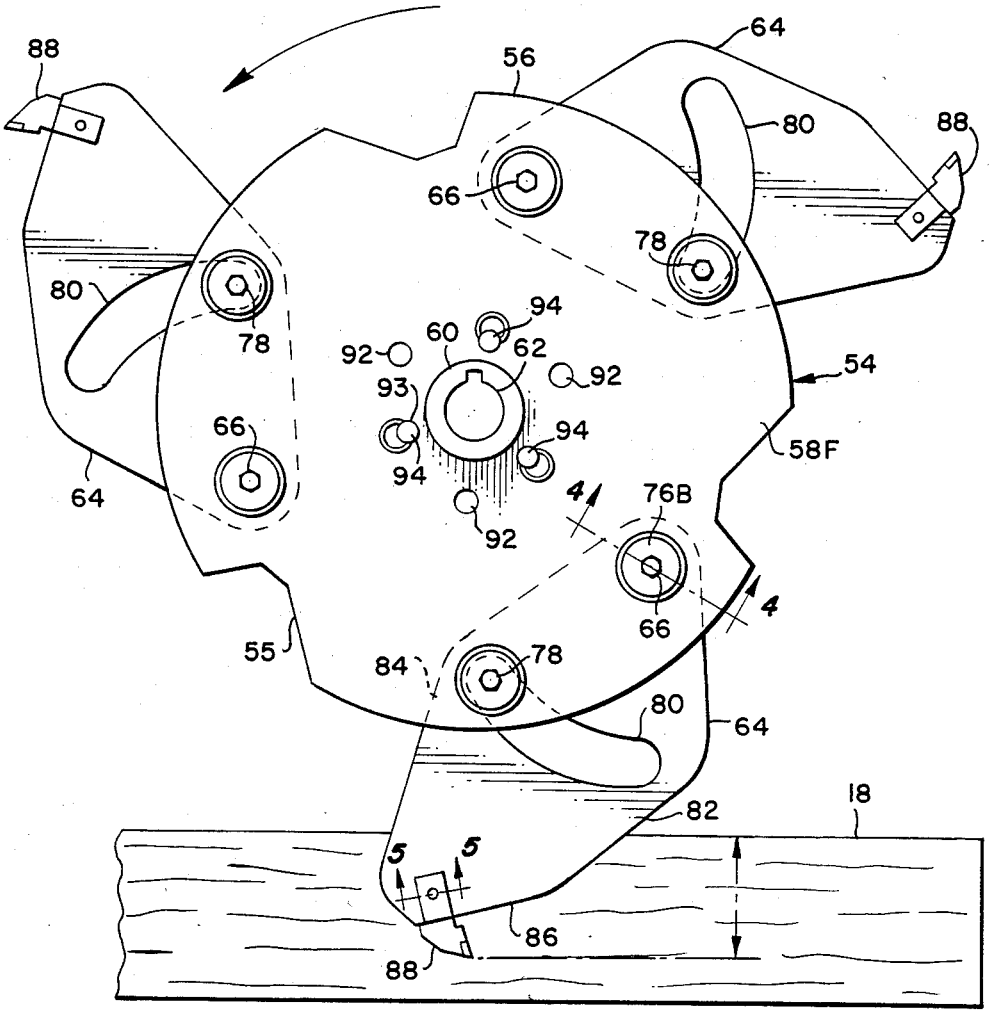
FIG. 3 shows a front view of the scarifier of the present invention with its hammer arms disposed in a cribbing state.

In the view of FIG. 3, the scarifier drum 56 is rotating counterclockwise as indicated. The hammer arms 64 are forced outward by centrifugal force. More specifically, each of the hammer arms 64 will be fully extended such that the stop pin bolt 78 and associated parts (i.e., an internal stop or slot pin identically constructed to the pivot pin 72 of FIG. 4) cooperates with the boundaries of the stop slot 80 to limit further outward movement of the hammer arm 64. As illustrated by the inclusion of the railroad tie 18 in FIG. 3, the hammer arm 64 and, more specifically, the hammer portion 86 and hammer tooth 88 will extend downward below the upper surface of the tie 18. Preferably, the hammer arm 64 extends downwardly to the same depth as the sweeper elements. In the position of FIG. 3, each of the hammer arms 64 is in a cribbing state as will be discussed in detail below.

Figure 7:
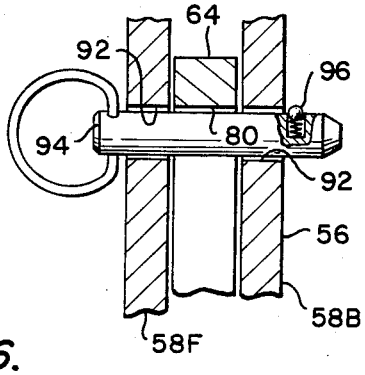
FIG. 7 shows a fragmentary cross-section view taken along lines 7—7 of FIG. 6.
Figure 6:
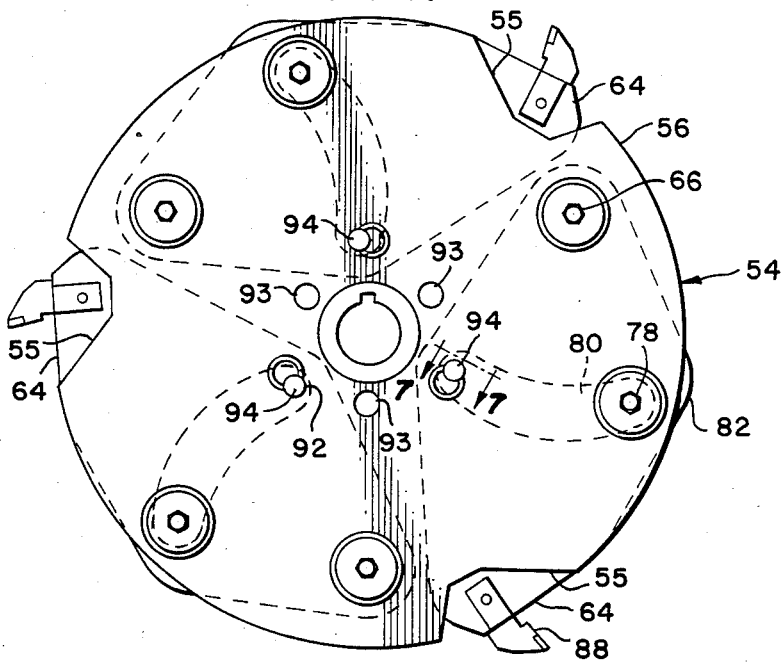
FIG. 6 shows a front view of the scarifier of the present invention with its hammer arms locked in a storage state.

With reference now to FIGS. 6 and 7, a nonoperating or storage position for the hammer arms 64 is shown. In particular, the hammer arms 64 have been retracted or pivoted to their inner-most positions with the slot 80 abutting the stop pin bolt 78 and associated stop pin adjacent the leading edge 82 of the hammer arm 64. When it is desired to place the scarifier 54 in its storage position, rotation of the drum 56 is initially stopped. One may then simply manually push each of the hammer arms 64 into their retracted position and lock them in place by use of the quick release lock pin 94 including a spring-biased ball 96 (best shown in FIG. 7). In particular, each of the three identically constructed lock pins 94 may be moved from storage holes 93 (best seen in FIG. 6) into lock holes 92 (best shown in FIGS. 3 and 7). The lock pins 94 extend through the lock holes 92 and through the slots 80 to secure the hammer arms 64 in their retracted position illustrated by FIG. 6. The spring-biased ball 96 of the lock pin may be captured within a small generally cylindrical chamber. By use of the three quick release lock pins 94, each of the hammer arms 64 may be retracted while the vehicle 10 is moving along a railroad bed which does not need the cribbing operation. Additionally, the hammer arms 64 may be retracted while the vehicle 10 is moving along a section of road bed which does not need the scarifier 54 to operate. That is, if the ballast is not hardened or relatively rigid, the hammer arms 64 may be maintained in their retracted positions and the cribbing operation can be carried out by the front and back sweepers.

OPERATION

With reference initially to FIGS. 1, 2, 3, and 6, the operation of the invention will be discussed. The scarifying vehicle 10 moves down a railroad bed 16 as powered by hydraulic motor 34, the vehicle supported on one side by two wheels 14 riding on a rail 12 and supported on the other side by two skids 24. The rotary sweepers 46F and 46B clean the tops of the railroad ties and remove ballast from in between the railroad ties. The quick release pins 94 and hammer arms 64 are in the positions illustrated by FIG. 6.

Figure 4:
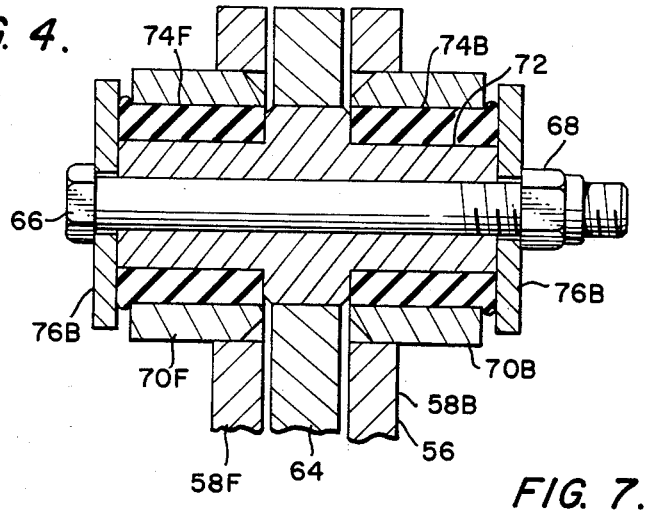
FIG. 4 shows a cross-section view taken along lines 4—4 of FIG. 3.
Figure 5:
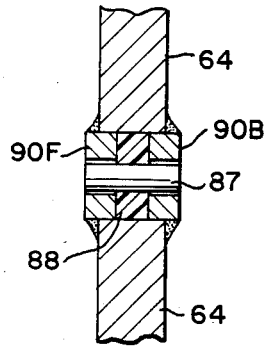
FIG. 5 shows a cross-section view taken along lines 5—5 of FIG. 3.

When the scarifying vehicle 10 reaches ballast which is hardened sufficiently that it is not moved by the flexible bristles or sweeper elements 48, a laborer may stop the machine and rotation of the drive shaft 44 and move the quick release or lock pins 94 from their locking positions in holes 92 (FIG. 6) to their storage position within holes 93. Each of the hammer arms 64 is then free to pivot about its pivot pin bolt 66 and associated pivot pin 72 (FIG. 4). Upon restarting the machine the centrifugal force of the drum 56 rotating at approximately 120 revolutions per minute causes the three hammer arms 64 to move to their fully extended position as illustrated in FIG. 3. This allows the hammer arms 64 to dig into and hammer away at the ballast in between the ties such as tie 18 of FIG. 3. Preferably, the hammer teeth 88 extend below the upper surface of the ties 18 the same distance as the sweeper elements 48 extend below the upper surfaces. Accordingly, the hammer portions 86 including hammer bits or teeth 88 will fracture the hardened ballast.

Figure 8:
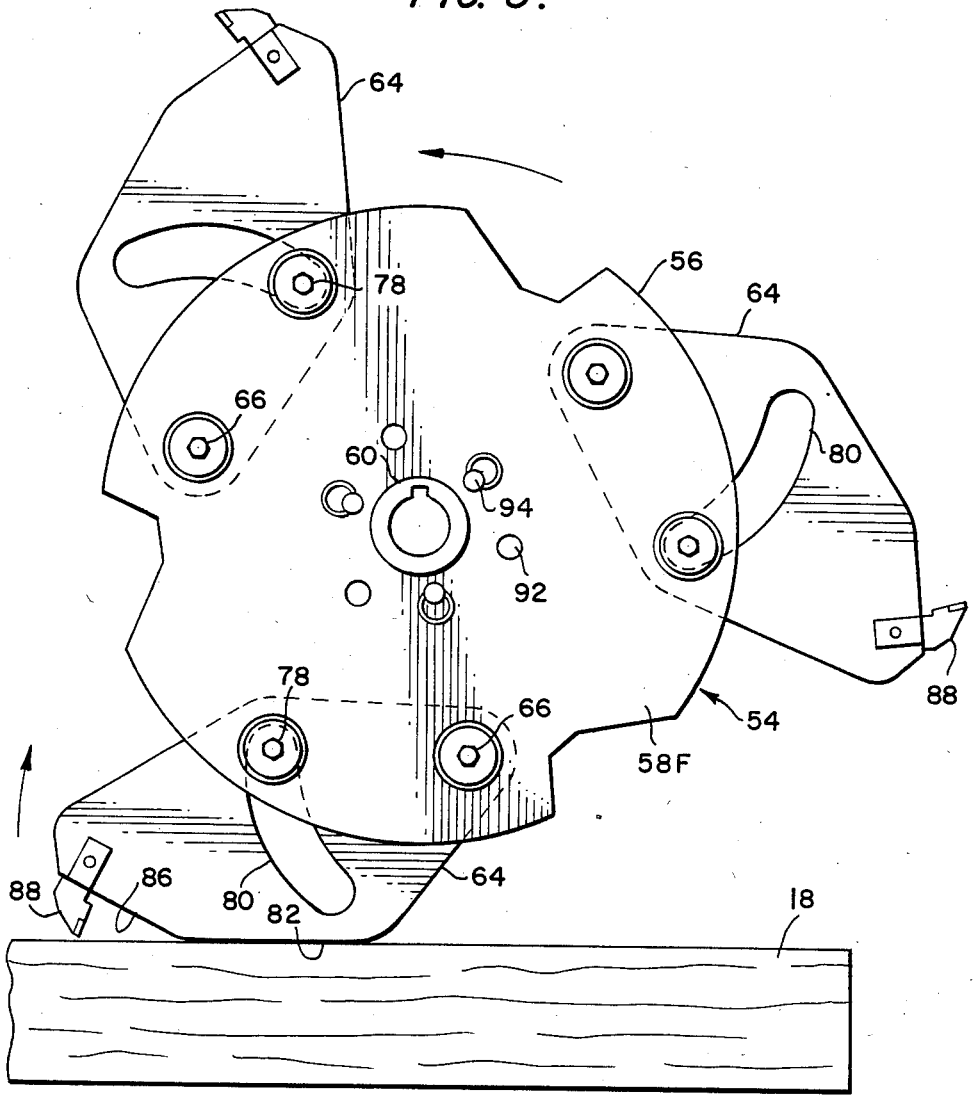
FIG. 8 shows a front view of the scarifier of the present invention as one hammer arm is shifting into a tie protecting state.

As discussed in detail above, a problem with typical prior art scarifier wheels is the requirement of an operator to individually raise and lower the scarifier in between adjacent ties. With reference now to FIG. 8, it will be appreciated that the present scarifier 54 avoids this problem. In particular, when the scarifier drum 56 begins rotating over a tie 18, the tie protector or flat leading edge tie protecting portion 82 will strike the tie 18 in the manner shown in FIG. 8 for the lower hammer arm 64. The flat leading edge tie protecting portion 82 will be disposed parallel or substantially parallel (i.e., at least within 10 degrees) of the upper surface of the tie 18. As illustrated in FIG. 8, the hammer portion 86 including hammer tooth 88 lag behind the leading edge 82. More specifically, the hammer tooth 88 is arranged so that its point will just barely touch the tie 18 when the flat leading edge tie protecting portion 82 fully strikes the tie 18. Recalling that the drum 56 and the hammer arms 64 will be rotating at about 120 rpm, one will appreciate that the flat leading edge 82 of hammer arm 64 strikes the tie relatively hard. Accordingly, the hammer arm 64 will bounce upward and away from the tie 18, although the drum or mounting piece 56 continues to rotate. That is, the hammer arm 64 will pivot clockwise about pivot pin bolt 66 with the stop pin bolt 78 and the stop slot 80 allowing the pivoting. Basically, the particular hammer arm 64 which has struck the tie 18 will pivot inward towards a retracted position such that the tooth 88 will rotate by and above the tie 18 without damaging the tie 18. After the hammer arm 64 has recovered from the retracting momentum given it by the collision with the tie 18, the hammer arm 64 will again be fully extended by the centrifugal force. As each hammer arm 64 strikes the tie 18, damage to the tie will be prevented by the tie protecting portion 82 changing the hammer arm from a cribbing state to a tie protecting state corresponding to the hammer arm beginning to move inward or be retracted against its centrifugal force. The collision between the tie protecting portion 82 and the tie 18 will simply make a flat very slight dent in the tie 18 at the worst, whereas a significant collision between the teeth 88 and the ties 18 would deeply gouge and damage the ties 18. The slight mark or depressions made by the tie protector portion 82 hitting the ties 18 does not affect the usability of the ties.

When the scarifier 54 has moved out from over the tie 18 such that it is now disposed between two of the ties 18, each of the hammer arms 64 will be fully extended and again start smashing and hammering at any hardened ballast in between the ties.

The machine or vehicle 10 may move along the track at about 40 to 50 feet a minute with the scarifier drum 56 rotating at about a 120 rpm. Because each of the tie protectors or tie protecting portions 82 of the hammer arms 64 indicates the presence of a tie and automatically prevents the hammer portion 86 and its hammer tooth 88 from damaging the tie, there is no need to have an operator on the machine to raise and lower a scarifying device in between adjacent ties. Instead, the machine may move along automatically protecting the ties as necessary while simultaneously hammering and fracturing the hardened ballast.

The scarifying vehicle 10 is very effective at saving labor in that a laborer who has other duties in a railroad work gang may simply use the lock pins 92 to release the hammer arms 64 when he notes the presence of hardened ballast. Likewise, he may relock the hammer arms 64 to their position in FIG. 3 wherein notches 55 within the drum 56 accomodate the teeth 88. The person who locks and unlocks the hammer arms 64 may ordinarily be operating another machine because the hammer arms 64 automatically protect the ties 18.

With reference to FIG. 1 it will be seen that the front sweeper 46F is sweeping the tops of the ties 18, but is unable to penetrate the hardened ballast 20. However, the scarifier 54 may break up the hardened ballast into broken up parts 20B. Those broken up parts 20B which have not been cleared from between the ties by the scarifier 54 itself will be swept aside to a sufficient depth for applying rail anchors by the back sweeper 46B.

From the above description of the operation of the present invention, it will be seen that the method of scarifying a railroad crib according to the present invention comprises the steps of: moving the scarifying device 54 transverse to railroad ties 18, the scarifying device including a first hammer portion 86; repeatedly hitting ballast in between the ties with the first hammer portion extending down to below upper surfaces of the ties; sensing when the first hammer portion 86 is over one of the ties by operation of a first tie protector 82; and automatically preventing the first hammer portion 86 from extending down sufficiently far as to damage a tie when the first tie protector senses that the first hammer portion is over one of the ties. The hitting step corresponds to the cribbing state for the first hammer portion (i.e., hammer arm 64 fully extended as in FIG. 3), whereas the preventing step corresponds to the tie protecting state caused by the collision of the tie protector 82 with the tie 18.

It should be noted that it is the bouncing which causes retraction of the hammer arm 64 and which prevents the hammer tooth 88 from significantly hitting and damaging the tie 18. If one turned the drum 56 at a sufficiently slow speed, the bounce-induced retraction of the hammer arm 64 would not be sufficient to cause the tooth 88 to avoid the tie 18. Of course, such a slow speed of rotation for the drum 56 would apply very little centrifugal force to the hammer arms 64 and the tooth 88 would therefore be likely to simply slide across the top of the tie 18. However, it is preferable that the machine be started with the scarifier 54 disposed over a ballast such that it may properly gain speed to minimize the possibility of the tooth 88 catching on the tie 18 during start up.

The hammer arms 64 and drum halves 58F and 58B and other principal parts of the present invention are made of metal, whereas the hammer teeth 88 are conventional coal mining carbide teeth. The teeth would be replaced as necessary. It should be noted that the rubber compression material 74F and 74B in FIG. 4 and similar compression material which would be used in connection with the slide or stop pin associated with bolt 78 are used to lessen the sound of the hammer arm 64 retracting and extending as respectively caused by collisions with the ties and the centrifugal force of rotation.

Although specific constructions have been described herein, it will be readily understood that these are for illustrative purposes only. Various modifications and adaptations will be readily apparent to those of ordinary skill in art. For example, the stop slots could be disposed on the drum or mounting piece 56 and the stop pins could be fixed on the hammer arms. Accordingly, the scope of the present invention should be determined by reference to the claims appended hereto.

What is claimed is:

1. An invention comprising a railroad crib scarifying device including a mounting piece and hammer means including at least a first hammer arm movably attached to said mounting piece and operable to extend out a variable distance from said mounting piece, said first hammer arm having a first hammer portion and a first tie protecting portion, and wherein said hammer means functions to loosen up ballast in a railroad track bed with first hammer arm automatically changing between:

I. a cribbing state with said first hammer portion extending downwardly between two adjacent railroad ties such that said first hammer portion is operative to strike and loosen up ballast between the two adjacent railroad ties; and II. a tie protecting state resulting from said first tie protecting portion contacting a railroad tie and preventing said first hammer portion from damaging the contacted railroad tie.

2. The invention of claim 1 wherein said hammer means of said scarifying device further includes: a second hammer arm having a second hammer portion and a second tie protecting portion and operable in cribbing and tie protecting states in the same manner as set forth for said first hammer arm.

3. The invention of claim 1 wherein said mounting piece is completely rotatable in a first direction about a rotation axis, and wherein first hammer arm is operable to extend out in a fully extended position from said mounting piece by centrifugal force resulting from rotation of said mounting piece.

4. The invention of claim 3 wherein said first tie protecting portion is operable to prevent said first hammer portion from damaging railroad ties by contacting the railroad ties and preventing said first hammer arm from maintaining its fully extended position.

5. The invention of claim 4 wherein said scarifying device further includes: a first stop slot in one of said mounting piece and said first hammer arm, and first stop pin extending within said first stop slot and fixed to the other of said mounting piece and said first hammer arm, and wherein said first stop slot and said first stop pin are together operable to limit outward movement of said first hammer arm relative to said mounting piece.

6. The invention of claim 4 wherein said first tie protecting portion is a flat leading surface on said first hammer arm and said first hammer portion includes a hammer tooth mounted on a hammer surface which lags behind said flat leading surface during rotation of said mounting piece.

7. The invention of claim 6 wherein said flat leading surface is operable to strike ties when it is substantially parallel to upper surfaces of the ties.

8. The invention of claim 6 wherein said hammer means of said scarifying device further includes: second and third hammer arms having respective second and third hammer portions and respective second and third tie protecting portions, each of said second and third hammer arms being of like construction and like operation as set forth for said first hammer arm.

9. The invention of claim 8 wherein said scarifying device further includes: a first stop slot in one of said mounting piece and said first hammer arm, and a first stop pin extending within said first stop slot and fixed to the other of said mounting piece and said first hammer arm, and wherein said first stop slot and said first stop pin are together operable to limit outward movement of said first hammer arm relative to said mounting piece; a second stop slot in one of said mounting piece and said second hammer arm, and a second stop pin extending with said second stop slot and fixed to the other of said mounting piece and said second hammer arm, and wherein said second stop slot and said second stop pin are together operable to limit the outward movement of said second hammer arm relative to said mounting piece; and a third stop slot in one of said mounting piece and said third hammer arm, and a third stop pin extending with said third stop slot and fixed to the other of said mounting piece and said third hammer arm, and wherein said third stop slot and said third stop pin are together operable to limit the outward movement of said third hammer arm relative to said mounting piece.

10. The invention of claim 8 wherein each of said hammer arms is pivotably mounted to said mounting piece.

11. An invention comprising a railroad crib scarifying device including a mounting piece, a hammer means including a first hanmer portion, and a first tie protecting portion, and wherein said hammer means functions to loosen up ballast in a railroad track bed by providing automatic changing between:

I. a cribbing state with said first hammer portion between two adjacent railroad ties such that said first hammer portion is operative to strike and loosen up ballast between the two adjacent railroad ties, and II. a tie protecting state resulting from said first tie protecting portion contacting a railroad tie and preventing said first hammer portion from damaging the contacted railroad tie.

12. The invention of claim 11 wherein said first tie protecting portion is a flat leading surface and said first hammer portion includes a hammer tooth which lags behind said flat leading surface during rotation of said mounting piece.

13. The invention of claim 11 wherein said hammer means of said scarifying device further includes: second and third hammer portions and second and third tie protecting portions, each of said second and third hammer portions being of like construction and operation as set forth for said first hammer portion, and each of said second and third tie protecting portions being of like construction and like operation as set forth for said first tie protecting portion.

14. The invention of claim 11 wherein said first hammer portion and said first tie protecting portion are part of a first hammer arm pivotably mounted to said mounting piece.

15. The invention of claim 14 wherein said scarifying device further includes: a first stop slot in one of said mounting piece and said first hammer arm, and a first stop pin extending within said first stop slot and fixed to the other of said mounting piece and said first hammer arm, and wherein said first stop slot and said first stop pin are together operable to limit outward movement of said first hammer arm relative to said mounting piece.

16. The invention of claim 11 further comprising a railroad crib scarifying vehicle, and wherein said railroad crib scarifying device is mounted to said vehicle.

17. An invention comprising a railroad crib scarifying vehicle including a scarifying system having a mounting piece, a hammer means with a first hammer portion, and a first tie protector, and said hammer means functions to loosen up ballast in a railroad track bed with said scarifying system providing automatic changing between:

I. a cribbing state with said first hammer portion extending downwardly between two adjacent railroad ties such that said first hammer portion is operative to strike and loosen up ballast between the two adjacent railroad ties; and II. a tie protecting state wherein said first tie protector indicates the presence of a railroad tie below said first hammer portion and prevents said first hammer portion from damaging the railroad tie.

18. The invention of claim 17 wherein said first tie protector is a flat leading surface and said first hammer portion includes a hammer tooth which lags behind said flat leading surface such that said first tie protector strikes railroad ties and prevents said hammer tooth from damaging railroad ties.

19. The invention of claim 18 wherein said flat leading surface is operable to strike ties when it is substantially parallel to upper surfaces of the ties.

20. The invention of claim 18 wherein said first tie protector and said first hammer portion are part of a first hammer arm movably mounted to said mounting piece.

21. The invention of claim 17 wherein said scarifying system further includes a second hammer portion and a second tie protector, each of like construction and like operation as set forth respectively for said first hammer portion and said first tie protector.

22. The invention of claim 17 wherein said mounting piece at least partially rotates in a first direction about a rotation axis.

23. The invention of claim 17 wherein said mounting piece is completely rotatable in a first direction about a rotation axis and wherein said first hammer portion lags behind said first tie protector during rotation of said mounting piece.

24. An invention comprising a railroad crib scarifying device including a rotatable mounting piece and a hammer means having at least a first hammer arm movable attached to said mounting piece and operable to extend out a variable distance from said mounting piece, a first stop slot in one of said mounting piece and said first hammer arm, a first stop pin extending within said first stop slot and fixed to the other of said mounting piece and said first hammer arm, and wherein said first hammer arm is operable to swing out from said mounting piece under centrifugal force resulting from rotation of said mounting piece, and wherein said first stop slot and said first stop pin are together operable to limit the outward movement of said first hammer arm relative to said mounting piece, and wherein said first hammer arm has a first hammer portion and a first tie protecting portion, and wherein said hammer means functions to loosen up ballast in a railroad track bed with said first hammer arm automatically changing between:

I. a cribbing state with said first hammer portion extending downwardly between two adjacent railroad ties such that said first hammer portion is operative to strike and loosen up ballast between the two adjacent railroad ties; and II. a tie protecting state resulting from said first tie protecting portion contacting a railroad tie and preventing said first hammer portion from damaging the contacted railroad tie.

25. The invention of claim 24 further comprising a railroad crib scarifying vehicle, and wherein said railroad crib scarifying device is mounted to said vehicle.

26. The invention of claim 24 wherein said hammer means of said device further includes: a second hammer arm movably attached to said mounting piece and operable to extend out a variable distance from said mounting piece, a second stop slot in one of said mounting piece and said second hammer arm, a second stop pin extending within said second stop slot and fixed to the other of said mounting piece and said second hammer arm, and wherein said second hammer arm is operable to swing out from said mounting piece under centrifugal force resulting from rotation of said mounting piece, and wherein said second stop slot and said second stop pin are together operable to limit the outward movement of said second hammer arm relative to said mounting piece.

27. The invention of claim 24 wherein said mounting piece is completely rotatable in a first direction about a rotation axis and wherein said first hammer portion lags behind said first tie protecting portion during rotation of said mounting piece.

28. The invention of claim 24 wherein said first tie protecting portion is a flat leading surface on said first hammer arm and said first hammer portion includes a hammer tooth mounted on a hammer surface which lags behind said flat leading surface during rotation of said mounting piece.

29. A method of scarifying a railroad crib, the steps comprising:

moving a scarifying device transverse to railroad ties, said scarifying device including a first hammer portion and a first tie protector;

repeatedly hitting ballast in between the ties with said first hammer portion extending down to below upper surfaces of the ties;

sensing when said first hammer portion is over one of the ties by operation of a first tie protector; and automatically preventing said first hammer portion from extending down sufficiently far as to damage a tie when the first tie protector senses that said first hammer portion is over one of the ties.

30. The method of claim 29 wherein said scarifying device includes a mounting piece and a first hammer arm movably attached to said mounting piece and operable to extend out a variable distance from said mounting piece, said first hammer arm including said first hammer portion; and said hitting step corresponds to a cribbing state with said first hammer portion extending downwardly directly between two adjacent railroad ties such that said first hammer portion is operative to strike and loosen up ballast between the two adjacent railroad ties, and said preventing step corresponds to a tie protecting state wherein said first tie protector indicates the presence of a railroad tie below said first hammer portion and prevents said first hammer portion from damaging the railroad tie.

* * * * *